United States Patent [19]

Cawlfield et al.

[11] Patent Number: 5,041,196

[45] Date of Patent: Aug. 20, 1991

[54] ELECTROCHEMICAL METHOD FOR PRODUCING CHLORINE DIOXIDE SOLUTIONS

[75] Inventors: David W. Cawlfield; Jerry J. Kaczur, both of Cleveland, Tenn.

[73] Assignee: Olin Corporation, Cheshire, Conn.

[21] Appl. No.: 456,437

[22] Filed: Dec. 26, 1989

[51] Int. Cl.[5] ..... C25B 1/00

[52] U.S. Cl. ..... 204/101; 204/95; 204/98; 204/103; 204/129

[58] Field of Search ..... 204/95, 98, 101, 103, 204/129

[56] References Cited

U.S. PATENT DOCUMENTS

| | | | |
|---|---|---|---|
| 2,163,793 | 6/1939 | Logan | 204/9 |
| 2,717,237 | 9/1955 | Rempel | 204/101 |
| 4,456,510 | 6/1984 | Murakami et al. | 204/101 |
| 4,542,008 | 9/1985 | Capuano et al. | 423/477 |
| 4,683,039 | 7/1987 | Twardowski et al. | 204/95 |
| 4,806,215 | 2/1989 | Twardowski | 204/98 |
| 4,853,096 | 8/1989 | Lipsztajn et al. | 204/101 |

FOREIGN PATENT DOCUMENTS

| | | |
|---|---|---|
| 1956153 | 3/1956 | Japan . |
| 158883 | 12/1981 | Japan . |

OTHER PUBLICATIONS

"Chlorine Dioxide Chemistry and Environmental Impact of Oxychlorine Compounds", published 1979 by Ann Arbor Science Publisher's Inc., p. 130.

*Primary Examiner*—John F. Niebling
*Assistant Examiner*—David G. Ryser
*Attorney, Agent, or Firm*—Ralph D'Alessandro

[57] ABSTRACT

An electrochemical process and electrolytic cell for manufacturing chlorine-free chlorine dioxide from dilute alkali metal chlorite solutions in a single step is disclosed. The electrolytic cell uses a porous flow-through anode and a cathode separated by a suitable separator.

15 Claims, 3 Drawing Sheets

ELECTROCHEMICAL METHOD FOR PRODUCING CHLORINE DIOXIDE SOLUTIONS

BACKGROUND OF THE INVENTION

This invention relates generally to the production of chlorine dioxide. More particularly the present invention relates to the electrochemical process and the electrolytic cell structure used to manufacture chlorine-free chlorine dioxide from dilute alkali metal chlorite solutions. Chlorine dioxide is commercially employed as a bleaching, fumigating, sanitizing or sterilizing agent.

The chlorine dioxide can be used to replace chlorine and hypochlorite products more traditionally used in bleaching, sanitizing or sterilizing applications with resultant benefits. Chlorine dioxide is a more powerful sterilizing agent and requires lower dose levels than chlorine, at both low and at high pH levels, although it is not particularly stable at high pH levels. Chlorine dioxide produces lower levels of chlorinated organic compounds than chlorine when sterilizing raw water. Additionally, chlorine dioxide is less corrosive to metals and many polymers than chlorine.

The electrochemical production of chlorine dioxide is old and well known. U.S. Pat. No. 2,163,793 to J.O. Logan, issued June 27, 1939, discloses a process which electrolyzes solutions of an alkali metal chlorite containing an alkali metal chloride as an additional electrolyte for improving the conductivity of the solution. The process preferably electrolyzes concentrated chlorite solutions to produce gaseous chlorine dioxide in the anode compartment of an electrolytic cell having a porous diaphragm between the anode and the cathode compartments.

A process for electrolyzing an aqueous solution containing a chlorite and a water soluble salt of an inorganic oxy-acid other than sulfuric acid is disclosed in British Patent No. 714,828, published Sept. 1, 1954, by Farbenfabriken Bayer. Suitable soluble salts include sodium nitrate, sodium nitrite, sodium phosphate, sodium chlorate, sodium perchlorate, sodium carbonate and sodium acetate.

A process for producing chlorine dioxide by the electrolysis of a chlorite in the presence of a water soluble metal sulfate is taught by Rempel in U.S. Pat. No. 2,717,237, issued Sept. 6, 1955.

Japanese Patent No. 1866, published Mar. 16, 1966, by S. Saito et al teaches the use of a cylindrical electrolytic cell for chlorite solutions having a porcelain separator between the anode and the cathode. Air is used to strip the chlorine dioxide from the anolyte solution.

Japanese Patent Publication No. 81-158883, published Dec. 7, 1981, by M. Murakami et al describes an electrolytic process for producing chlorine dioxide by admixing a chlorite solution with a catholyte solution for a diaphragm or membrane cell to maintain the pH within the range of from about 4 to about 7 and electrolyzing the mixture in the anode compartment. The electrolyzed solution, at a pH of 2 or less, is then fed to a stripping tank where air is introduced to recover the chloride dioxide.

U.S. Pat. No. 4,542,008 to Capuano et al, issued Sept. 17, 1985, teaches a process for electrolyzing aqueous chlorite solutions where the sodium chlorite concentration in the anolyte is controlled by means of a photometric cell to maintain a concentration of about 0.8 to about 5% by weight. Capuano et al further teaches the use of carbon, graphite or titanium or tantalum anodes, the latter two having an electrochemically active coating. The cell is divided by a permselective cation exchange membrane.

A disadvantage of all of the above electrolytic processes is the production of chlorine dioxide in the anode compartment of the cell so that the chlorine dioxide must be recovered from the anolyte by stripping with air or some other appropriate means. If this stripping step is not accomplished, the conversion of chlorite to chlorine dioxide in the electrolyte is typically less than 20% and the direct use of the anolyte would be economically infeasible. Operation of these electrolytic processes under conditions where higher conversion rates are attempted by applying more current and lower electrolyte feed rates results in the formation of chlorate and/or free chlorine. Since chlorine is an undesirable contaminant and since the formation of chlorate is irreversible, there is a need to develop a process by which chlorite can be converted to chlorine dioxide efficiently without a separation step.

The use of chlorine dioxide solutions poses a significant problem because the generation of chlorine-free chlorine dioxide is complex and requires a number of purification steps. These steps may include the aforementioned stripping and the reabsorbing of chlorine dioxide from a generating solution to a receiving solution. A stream of air is frequently used for this purpose. However, operation of such a process is hazardous if the chlorine dioxide concentrations in the air become high enough to initiate spontaneous decomposition.

U.S. Pat. No. 4,683,039 to Twardowski et al describes another method of accomplishing this purification step by use of a gas-permeable hydrophobic membrane. This method reduces the risk of chlorine dioxide decomposition that requires additional costly equipment.

These and other problems are solved in the design of the present invention by employing a continuous electrochemical process and an electrolytic cell in the production of chlorine-free chlorine dioxide in a concentration of at least about 2 to about 10 grams per liter (gpL) and as much as about 14 gpL from dilute alkali metal chlorite solutions in a single step by use of a porous flow-through anode.

SUMMARY OF THE INVENTION

It is an object of the present invention to provide an improved electrolytic process and apparatus that produces a chlorine dioxide solution from aqueous chlorite directly from an electrochemical cell without the need for further recovery steps of the chlorine dioxide.

It is another object of the present invention to provide a process and apparatus that can be controlled to produce a controlled concentration and quantity of chlorine dioxide containing solution.

It is another object of the present invention to provide a process and apparatus for electrolytically producing chlorine dioxide solutions that are substantially free of chlorine and which contain minimal amounts of chlorite and chlorate salts.

It is a feature of the present invention that a porous, high surface area, flow-through anode is employed in conjunction with a cation-permeable membrane.

It is another feature of the present invention that suitable anodes employed in the apparatus and process of the present invention have a void fraction, defined as the percentage of total electrode volume that is not occupied by electrode material, of greater than about 40%.

It is an advantage of the present invention that unwanted side reactions that form chlorates are avoided.

It is another advantage of the present invention that the electrochemical process and the electrolytic cell can efficiently convert chlorite to chlorine dioxide over a broad pH range of about 2.0 to about 10.0.

It is still another advantage of the present invention that the chlorine dioxide is produced in solution form, rather than in gaseous form, and is usable directly without further processing.

These and other objects, features and advantages of the present invention are provided in a continuous electrochemical process and the electrolytic cell employing the process by the manufacture of chlorine-free chlorine dioxide from dilute alkali metal chlorite solutions in a single step that does not require further purification steps.

BRIEF DESCRIPTION OF THE DRAWINGS

These and other objects, features and advantages of the invention will become apparent upon consideration of the following detailed disclosure of the invention, especially when it is taken in conjunction with the accompanying drawings wherein.

DETAILED DESCRIPTION OF PREFERRED EMBODIMENT

Figure 1:
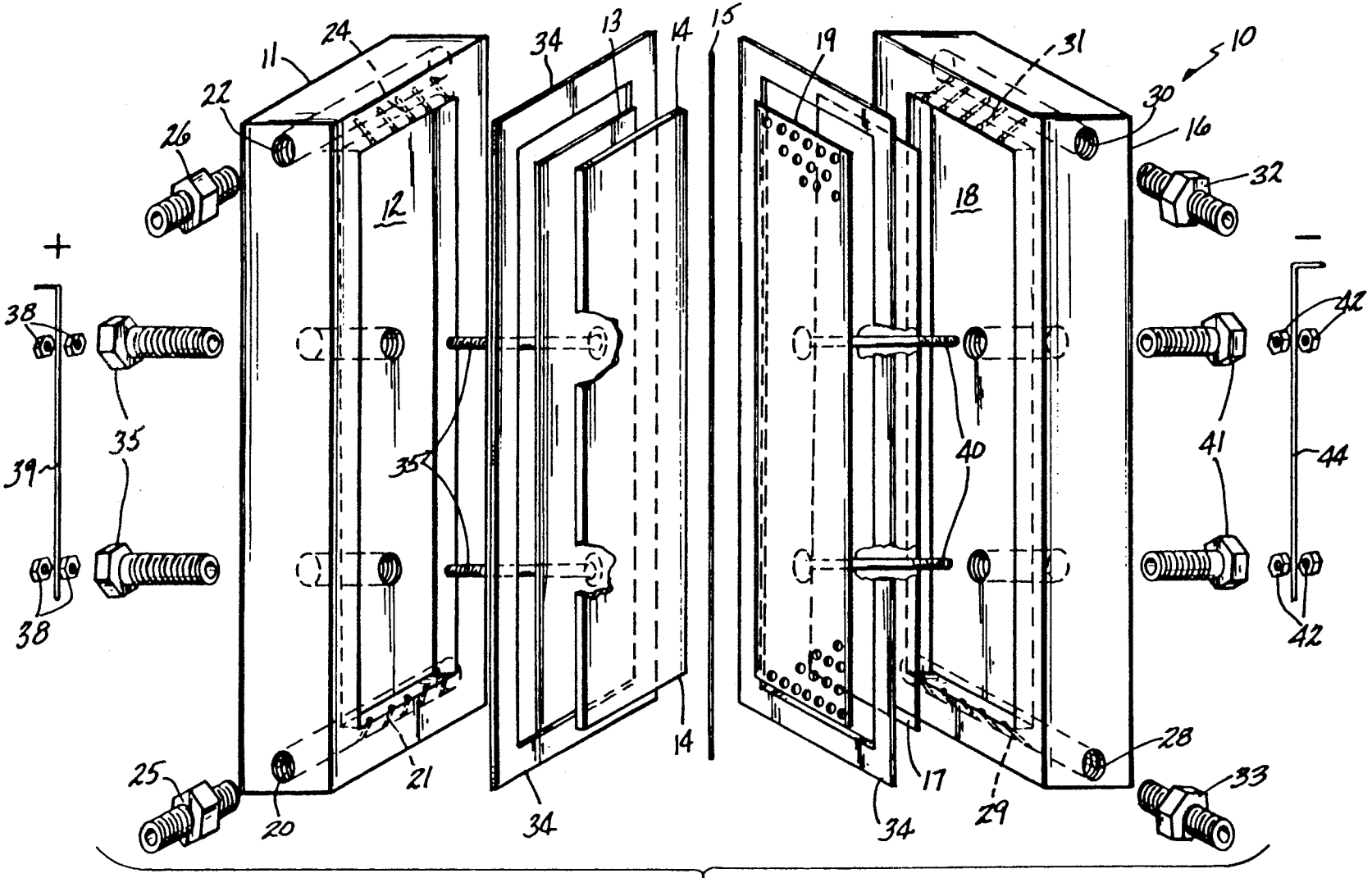
FIG. 1 is an exploded side elevational view of the electrolytic cell.
Figure 2:
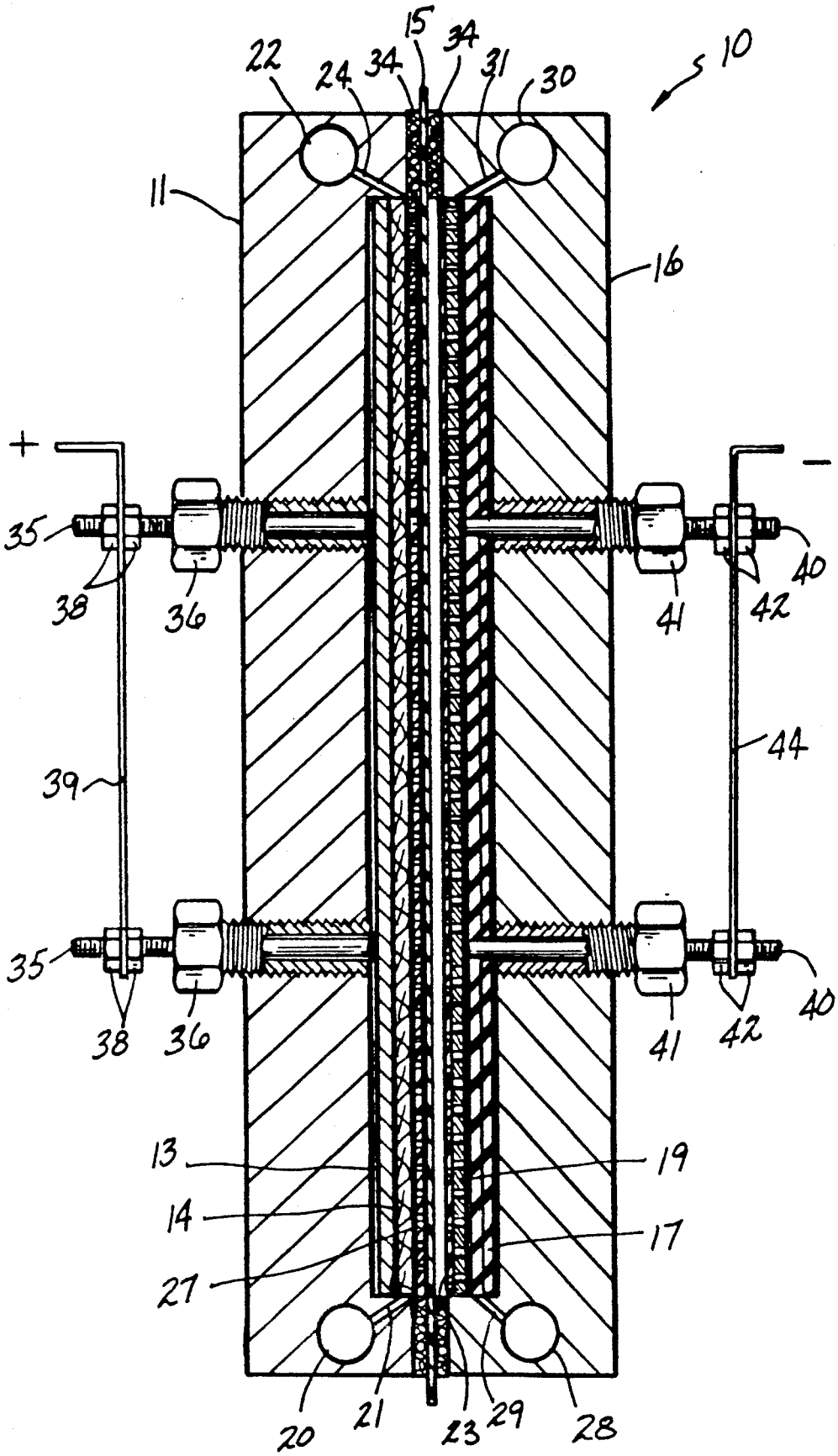
FIG. 2 is a sectional side elevational view of the electrolytic cell, but with the structure not in its fully compressed and assembled position.

The electrochemical cell indicated generally by the numeral 10 is shown in FIG. 1 in exploded view and in FIG. 2 an assembled view.

The electrochemical cell 10 is divided into an anolyte compartment 12 and catholyte compartment 18 by an oxidation resistant cation permeable ion exchange membrane 15. Appropriate sealing means, such as gaskets 34 or an O-ring, are used to create a liquid-tight seal between the membrane 15 and the anode frame 11 and the cathode frame 16.

The cathode side of the cell 10, in addition to the frame 16 and the compartment 18, includes a cathode 19 and a hydrogen gas disengaging material 17 fitted within the compartment 18. The cathode 19 is an electrode made of suitable material, such as smooth, perforated stainless steel. The cathode 19 is positioned flush with the edge of the cathode frame 16 by the use of the disengaging material 17, which is porous and physically fills the space between the inside portion of the frame 16 and the cathode 19.

Cathode conductor posts 40 transmit electrical current from a power supply (not shown) through current splitter wire 44 and cathode conductor post nuts 42 to the cathode 19. Cathode conductor post fittings 41 extend into the cathode frame 16 about posts 40 to seal against posts 40 and prevent the leakage of catholyte from the cell 10.

The preferred structure of the cathode 19 is a smooth, perforated stainless steel of the grade such as 304, 316, 310, etc. The perforations should be suitable to permit hydrogen bubble release from between the membrane 15 and the cathode 19. Other suitable cathode materials include nickel or nickel-chrome based alloys. Titanium or other valve metal cathode structures can also be used. A corrosion resistant alloy is preferred to reduce formation of some localized iron corrosion by-products on the surface of the cathode 19 due to potential chlorine dioxide diffusion through the membrane 15 by surface contact with the cathode 19. Other suitable materials of construction for the cathode 19 include fine woven wire structures on an open type metal substrate, which can help to reduce the cell voltage by promoting hydrogen gas bubble disengagement from the surface of the cathode 19.

The anode side of the cell 10, in addition to the frame 11 and the compartment 12 of FIG. 1, includes a porous, high surface area anode 14 and an anode backplate or current distributor 13 fitted within the compartment 12. The anode 14 is an electrode made of a suitable porous and high surface area material, which increases the rate of mass transport into and away from the anode electrode surface. The high surface area anode 14 distributes the current so that the rate of charge transfer from the electrode to the anolyte solution is much lower than the rate of charge transfer through the membrane and the bulk electrolyte. Materials with a surface area to volume ratio of about 50 $cm^2/cm^3$ or higher are suitable to achieve a high percentage chlorite to chlorine dioxide conversion, with higher surface area to volume ratios being more desirable up to the point where pressure drop becomes critical. The anode must be sufficiently porous to permit anolyte to pass through it during operation. The porosity must also be sufficient so that the effective ionic conductivity of the solution inside the electrode is not substantially reduced. Anodes with a void fraction of greater than about 40% are desirable to accomplish this.

The anode 14 is positioned flush with the edge of the anode frame 11 by the use of the high oxygen overvoltage anode current distributor 13, which physically fills the space between the inside portion of the frame 11 and the anode 14. The nature of the compressible, high overvoltage, porous and high surface area anode 14 also helps to fill the space within the anolyte compartment 12 and obtain alignment with the edges of the anode frame 11.

Anode conductor posts 35 transmit electrical current from a power supply (not shown) through current splitter wire 39 and anode conductor post nuts 38 to the anode 14. Anode conductor post fittings 36 extend into the anode frame 11 about posts 35 to seal against posts 35 and prevent the leakage of anolyte from the cell 10.

The anode current distributor or backplate 13 distributes the current evenly to the flexible and compressible porous, high surface area anode 14 which does most of the high efficiency electrochemical conversion of the chlorite solution to chlorine dioxide. High oxygen overvoltage anode materials and coatings are preferably used to increase current efficiency by decreasing the amount of current lost during the electrolysis of water to oxygen and hydrogen ions on the anode surface.

Suitable high oxygen overvoltage anode materials are graphite, graphite felt, a multiple layered graphite cloth, a graphite cloth weave, carbon, and metals or metal surfaces consisting of platinum, gold, palladium, or mixtures or alloys thereof, or thin coatings of such materials on various substrates. Precious metals such as iridium, rhodium or ruthenium, alloyed with platinum group metals could also be acceptable. For example, platinum electroplated on titanium or a platinum clad material could also be utilized for the anode 14 in conjunction with a gold, platinum or oxide coated titanium current distributor 13. A thin deposited platinum conductive coating or layer on a corrosion resistant high surface area ceramic, or high surface area titanium fiber structure, or plastic fiber substrate could also be used. Conductive stable ceramic electrodes, such as the material sold by Ebonex Technologies Inc. under the trade name Ebonex(®) can also be used.

The preferred structure of the anode 14 is a porous high surface area material of a compressible graphite felt or cloth construction. The graphite surfaces can be impregnated with metallic films or oxides to increase the life of the graphite. Other alternatives are fluoride surface treated graphite structures to improve the anode useful life by preventing degradation by the generation of small amounts of by-product oxygen on the surface of the graphite. Since such graphite structures are relatively inexpensive, they can be used as disposable anodes that can be easily replaced after a finite period of operation.

The anode backplate or current distributor 13 can be similarly made of a graphite material which can be surface treated with agents such as those used on the porous, high surface area anode material. Other alternative materials suitable for use in the current distributor include metallic films or oxides on stable, oxidation chemical resistant valve metal structures such as titanium, tantalum, niobium, or zirconium. The coating types are metallic platinum, gold, or palladium or other precious metal or oxide type coatings. There are other oxides, such as ferrite based and magnesium or manganese based oxides, which may be suitable.

A suitably diluted alkali metal chlorite feed solution, preferrably sodium or potassium, is fed into anolyte compartment 12 through anode solution entry port 20 and anolyte solution distributor channels 12 at a suitable flow rate to allow for the electrochemical conversion of the chlorite ion to chlorine dioxide by the flexible and compressible porous, high oxygen overvoltage, high surface area anode 14. The electrical current is conducted to anode 14 by the high oxygen overvoltage anode backplate or current distributor 13 which has one or more metallic anode conductor posts 35 to conduct the DC electrical power from a DC power supply (not shown). Fittings 36 are used to seal against conductor posts 35 to prevent solution leakage from the cell 10. Current splitter wire 39 and anode conductor post nuts 38 are used to distribute the electrical current to the anode distributor 13. The chlorine dioxide solution product exits through anode product distributor channels 24 and anode exit ports 22.

Softened or deionized water or other suitable aqueous solution flows through cathode solution entry port 28 and catholyte distributor channels 29 (only one of which is shown in FIG. 1) into the catholyte compartment 18 at an appropriate flow-rate to maintain a suitable operating concentration of alkali metal hydroxide. The alkali metal hydroxide is formed by alkali ions (not shown) passing from the anolyte compartment 12 through the cation permeable ion exchange membrane 15 into catholyte compartment 18 and by the electrical current applied at the cathode 19 to form the hydroxyl ions ($OH^-$) at the cathode surface. The cathodic reaction produces hydrogen gas, as well as the hydroxyl ions, from the electrolysis of water. The catholyte alkali metal hydroxide solution by-product and hydrogen gas (not shown) pass through cathode product distributor channels 31 into cathode exit ports 30 for removal from the cell 10 for further processing.

Electrolysis occurs in the cell 10 as the chlorite solution passes parallel to the membrane 15 through the anolyte compartment, causing the chlorine dioxide concentration to increase in the anolyte compartment 12 as the chlorite ion concentration decreases according to the following anodic reaction:

$$ClO_2 \rightarrow e^- + ClO_2.$$

Alkali metal ions, for example, sodium, from the anolyte pass through the membrane 15. As the chlorite ion content of the anolyte decreases and the chlorine dioxide content increases, a portion of the chlorine dioxide can be oxidized, depending upon the pH, to chlorate at the anode according to the following undesirable reaction:

$$ClO_2 + H_2O \rightarrow HClO_3 + H^+ + e^-.$$

This undesirable reaction can be avoided by maintaining a suitably acidic anolyte and, especially at higher pH's, by controlling the potential at the anode surface while providing mass transport of the chlorite ions from the bulk solution to the anode surface and the transport of chlorine dioxide away from the anode surface. This permits high chlorine dioxide yields to be obtained.

The gaskets 34 are preferably made of oxidation resistant rubber or plastic elastomer material. Suitable types of gaskets are those made from rubber type materials such as EPDM or that sold under the trade name Viton(®), etc.. Other suitable types of gasket materials include flexible closed foam types made from polyethylene or polypropylene which can be easily compressed to a thin layer to minimize distances between the membrane 15 and the anode 13 and cathode 19 structures.

Oxidation and high temperature resistant membranes 15 are preferred. Among these are the perfluorinated sulfonic acid type membranes such as DuPont NAFION® types 117, 417, 423, etc.., membranes from the assignee of U.S. Pat. No. 4,470,888, and other polytetrafluorethylene based membranes with sulfonic acid groupings such as those sold under the RAIPORE tradename by RAI Research Corporation. Other suitable types of membranes that are combinations of sulfonic acid/carboxylic acid moieties include those sold under the ACIPLEX tradename by the Asahi Chemical Company and those sold by the Asahi Glass Company under the FLEMION® tradename.

Optionally a thin protective non-conductive spacer material 27 shown in FIG. 2, such as a chemically resistant non-conductive plastic mesh or a conductive material like graphite felt, can be put between the membrane 15 and the surface of the anode 14 to permit the use of expanded metal anodes. A thin plastic spacer 23 can also be used between the cathode 19 and the membrane 15. This spacer 23 in the catholyte compartment 18 should also be a non-conductive plastic with large holes for ease of disengagement of the hydrogen gas from the catholyte compartment 18. It should be noted that FIG. 2 shows the cell 10 in cross-section, but before the cell 10 has been fully compressed in its assembled state. In this assembled state the space or gap shown in FIG. 2 between plastic spacer 23, spacer material 27 and the membrane 15 does not exist as the gaskets 34 are compressed down. The cell 10 preferably is operated with the membrane 15 in contact with the plastic spacer 23 and the spacer material 27 when they are employed and with the membrane 15 in contact with the cathode electrode 19 and the anode electrode 14 when they are not employed.

The preferred anolyte chlorite feed solution is sodium chlorite with a feed concentration of about 0.1 to about 30 gpL for one-pass through flow operation. Should it be desired to operate the cell 10 in a recirculation system, very strong sodium chlorite solutions can be used which will result in a low conversion rate of chlorite to chlorine dioxide per pass of anolyte through the anode 14. Additives in the form of salts can be used in the chlorite feed solution, such as alkali metal phosphates, sulfates, chlorides etc., to increase the conversion efficiency to chlorine dioxide, reduce operating voltage, provide pH buffering of the product solution, or add to the stability of the chlorine dioxide solution in storage.

Figure 3:
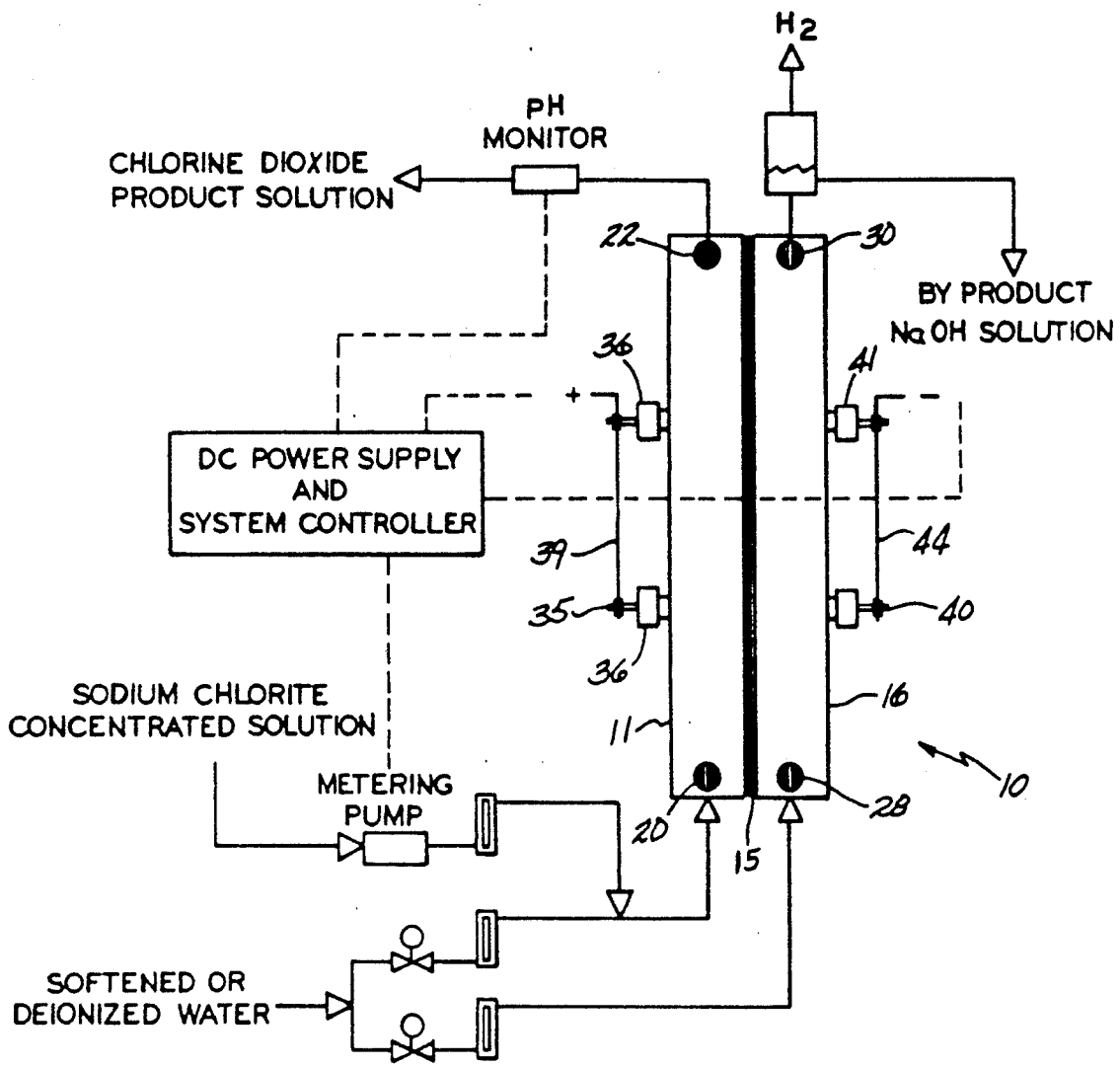
FIG. 3 is a diagrammatic illustration of a system employing the chlorine dioxide generating electrolytic cell.

In operation, the cell 10 in a system such as that shown in FIG. 3, operates with the electrolytes in a temperature range of from about 5 degrees Centigrade to about 50 degrees Centigrade, with a preferred operating temperature range of about 10 degrees Centigrade to about 30 degrees Centigrade. The anolyte feed has previously been identified as a sodium chlorite solution which is diluted by mixing with softened or deionized water to the desired concentration. The catholyte is either deionized water or softened water, depending on what is readily available and if the byproduct sodium hydroxide has a potential end use for other areas of the installation, such as for pH control.

The cell 10 uses an operating current density of from about 0.01 KA/m2 to about 10 KA/m2, with a more preferred range of about 0.05 KA/m2 to about 3 KA/m2. The constant operating cell voltage and electrical resistance of the anolyte and catholyte solutions are limitations of the operating cell current density that must be traded off or balanced with current efficiency and the conversion yield of chlorite to chlorine dioxide. The cell operating voltage depends on the oxygen overvoltage of the anode materials used in the anode structures. The higher the oxygen overvoltage of the anode materials, the higher voltage at which the cell 10 can be operated and still maintain a high current efficiency and yield to chlorine dioxide. The typical operating voltage range is between about 2.0 to about 5.0 volts, with a preferred range of about 2.5 to about 4.0 volts.

Additionally the ratio of the total surface area of the anode to the superficial surface or projected area of the membrane impacts the current density at which the cell 10 can be operated and the total cell voltage. The higher that this particular ratio is, the greater is the maximum current density and the lower is the total cell voltage at which the cell can be operated.

The anolyte flow rate through the cell 10 and the residence time of the anolyte in the cell 10 are factors that affect the efficiency of the conversion of the chlorite to chlorine dioxide. There are optimum flow rates to achieve high efficiency conversion of chlorite to chlorine dioxide and to obtain a specific pH final product solution needed for the commercial applications for a single pass flow through system. The typical residence times for the single pass flow through system in the cell 10 are between about 0.1 to about 10 minutes, with a more preferred range of about 0.5 to about 4 minutes to achieve high conversion of chlorite to chlorine dioxide with high current efficiency. Very long residence times can increase chlorate formation as well as reduce the pH of the product solution to very low values (pH 2 or below) which may be detrimental to the anode structures.

The catholyte and byproduct sodium hydroxide concentration should be about 0.1 to about 30 weight percent, with a preferred range of about 1 to about 10 weight percent. The optimum hydroxide concentration will depend on the membrane performance characteristics. The higher the caustic or sodium hydroxide concentration, the lower the calcium concentration or water hardness needed for long life operation of the membrane.

In order to exemplify the results achieved, the following examples are provided without intent to limit the scope of the instant invention to the discussion therein.

EXAMPLE 1

An electrochemical cell was constructed similar to that of FIG. 1 consistng of two compartments machined from about 1.0 inch (2.54 cm) thick acrylic plastic. The outside dimensions of both the anolyte and the catholyte compartments were about 8 inches (20.32 cm) by about 26 inches (66.04 cm) with machined internal chamber dimensions of about 6 inches (15.24 cm) by about 24 inches (60.96 cm) by about ⅛ inch (0.3175 cm) deep, The anolyte compartment was fitted with about a 6 inch (15.24 cm) by about 24 inch (60.96 cm) by about 1/16 inch (0.159 cm) thick titanium anode backplate with one side having an electroplated 100 microinch (2.54 micron) thick coating composed of 24 karat gold and the other side with two welded about 0.25 inch (0.635 cm) diameter by about 3 inch (7.62 cm) long titanium conductor posts. The conductor posts were fitted through holes to the outside of the anolyte compartment. The gold plated titanium plate was glued or sealed to the inside of the compartment with a silicone adhesive to prevent any fluid flow behind the anode backplate. The silicone adhesive takes up a thickness of about 0.0175 inches (0.0445 cm), leaving a recess thickness of about 0.045 inches (0.1143 cm) in the compartment. Then about ⅛ inch (0.3175 cm) thick high surface area graphite felt (Grade WDF) anode, available from the National Electric Carbon Corporation of Cleveland, Ohio was mounted against the gold plated titanium anode conductor backplate into the recess area. The anodic surface area to volume ratio for the high surface area graphite felt anode was about 300 $cm^2/cm^3$.

The cathode compartment was fitted with a perforated 304 type stainless steel plate of the same dimensions as the anode backplate but with a thickness of about 1/32 inch (0.0794 cm) and with two welded about ¼ inch (0.635 cm) by about 3 inch (7.62 cm) long 316 type stainless steel conductor posts. The cathode was mounted flush with the surface of the acrylic compartment with 2 pieces of about 0.045 inch (0.1143 cm) thickness polypropylene mesh spacer/support material behind the perforated cathode plate to allow for hydrogen gas disengagement. The polypropylene spacer material had about 3/16 inch (0.476 cm) square hole open areas.

The electrochemical cell assembly was completed using about 1/32 inch (0.0794 cm) EPDM peroxide cured rubber gaskets (Type 6962 EPDM compound), available from the Prince Rubber & Plastics, Co. of Buffalo, NY, glued to each cell compartment surface. A perfluorosufonic acid type cation permeable membrane with a 985 equivalent weight, obtained from the assignee of U.S. Pat. No. 4,470,888, was mounted between the anode and cathode compartments. The ratio of the total surface area of the anode to the superficial surface or projected area of the membrane was about 50.0. The cell was compressed and sealed together between two steel endplates with nuts and bolts and connected to a variable voltage control laboratory DC power supply with a maximum capacity of up to about 35 amperes.

The anolyte feed solution was composed of a softened water stream with about a 25 weight percent sodium chlorite solution metered into the flow stream to produce a diluted sodium chlorite feed solution to the anolyte with a concentration that could be varied between about 10 to about 20 gpL as sodium chlorite. A separate softened water stream was metered into the catholyte compartment at a flowrate of about 90 mL/min.

A corrosion resistant pH probe was mounted on the output of the anolyte stream to monitor the pH of the final product chlorine dioxide solution.

The chlorite feed solution flowrate to the cell was varied as well as product solution pH during a test run which extended over a period of more than 400 hours of operation. Operating at constant voltage between about 3.0 to about 3.2 volts with current varying between about 31 to about 34 amperes and producing a chlorine dioxide product solution with a pH of between about 6.5 to about 7.5, the cell produced a product solution containing an average of about 6 to about 8 gpL chlorine dioxide with about 2 to about 3 gpL unreacted sodium chlorite, for a chlorite conversion rate of between about 62 to about 75% and current efficiency between about 70% to about 85% in a single flow through pass operation. The by-product sodium chlorate concentration in the product solution ranged between about 1.4 to about 2.2 gpL at the various daily operating conditions. The chlorine dioxide production rate was between about 3.4 to about 4.2 lb/day.

EXAMPLE 2

An electrochemical cell was assembled with identical cell components to that of Example 1 except for changes as noted below in the anode materials and gasketing.

The titanium anode conductor backplate in this test cell had an electroplated about 100 microinch (2.54 micron) thick coating of platinum. In place of the graphite felt anode were four layers of about a 0.020 inch (0.0508 cm) bulk thickness flexible woven fiber graphite cloth, available from Fiber Materials, Inc. of Biddeford, Me. The anodic surface area to volume ratio for the high surface area woven fiber graphite cloth anode was about 2400 $cm^2/cm^3$. The ratio of the total surface area of the anode to the superficial surface or projected area of the membrane was about 480. The cell gaskets used were a soft about ⅛ inch (0.3175 cm) thick PVC-nitrile closed cell foam rubber product with a self adhesive backing, sold under the trade name ENSOLITE® MLC by Foamade Industries of Auburn Hills, Mich.).

The chlorite feed solution flowrate to the cell was varied, as well as the product solution pH, during a test run which extended over a period of about 500 hours of operation. Operating at constant voltage between about 2.7 to about 2.8 volts with current varying between about 31 to about 35 amperes and producing a chlorine dioxide product solution with a pH of between about 5.7 to about 7.0, the cell produced a product solution containing an average of about 6 to about 7.5 gpL chlorine dioxide with about 2 to about 4 gpL unreacted sodium chlorite. This produced a chlorite yield conversion rate of between about 62 to about 78% and a current efficiency of between about 71 to about 79% in a single flow through pass operation. The by-product sodium chlorate concentration in the product solution ranged between about 1.3 to about 2.1 gpL at the various daily operating conditions. The chlorine dioxide production rate was between about 3.1 to about 3.8 lb/day.

EXAMPLE 3

An electrochemical cell was assembled with identical cell components to that of Example 1 except for changes as noted below in the anode compartment dimensions, anode materials, and gasketing.

The anode compartment in this test cell was about 7/16 inch (1.111 cm) in depth to accommodate a graphite plate anode conductor backplate. The anode conductor backplate was about 0.310 inch (0.787 cm) thick Type AGLX graphite plate sold by the National Electric Carbon Corporation of Cleveland, Ohio. Two polyvinyl chloride (PVC) spacing sheets about 0.025 inch (0.0635 cm) thick were placed behind the gaphite plate and the entire backplate assembly was mounted in place with a silicone adhesive. Two titanium metal threaded anode conductor posts about ¼ inch (0.635 cm) diameter by about 3 inches (7.62 cm) length were mounted into the graphite block. The anode used was about an ⅛ inch (0.3175 cm) thick high surface area graphite felt (GF-S5), sold by the Electrosynthesis Company, Inc. of East Amherst, N.Y. The anodic surface area to volume ratio for the high surface graphite felt anode was about 300 $cm^2/cm^3$. The ratio of the total surface area of the anode to the superficial surface or projected area of the membrane was about 50.0.

The cell gaskets were soft polyethylene closed cell foam rubber product about ⅛ inch (0.3175 cm) thick with a self adhesive backing sold under the VOLARA trade name by Foamade Industries of Auburn Hills, Mich.

The chlorite feed solution flowrate to the cell was varied as well as product solution pH during a test run which extended over a period of more than 500 hours of operation. Operating at constant voltage between about 2.9 to about 3.1 volts with current varying between about 31 to about 35 amperes and producing a chlorine dioxide product solution with a pH of between about 6.5 to about 7.5, the cell produced a product solution containing an average of about 5.5 to about 6.5 gpL of chlorine dioxide with about 0.8 to about 2 gpL of unreacted sodium chlorite. This resulted in a conversion rate of chlorite to chlorine dioxide between about 65 to about 78% and current efficiencies between about 74 to about 82% in a single flow through pass operation. The by-product sodium chlorate concentration in the product solution ranged between about 0.8 to about 2.5 gpL at the various daily operating conditions. The chlorine dioxide production rate was between about 3.4 to about 3.6 lb/day.

EXAMPLE 4

Various gpL concentration chlorine-free chlorine dioxide product solutions from the electrochemical cell of Example 2 were air sparged to determine the amount of chlorine dioxide gas that could by recovered from the solution for applications requiring chlorine dioxide gas. The solution product samples were sparged with air for a period of about 90 seconds to obtain the gaseous form of chlorine dioxide instead of the normal solution form.

The following results were obtained as shown in Table I below. The chlorine dioxide recovery ranged from about 69.7% to as high as about 90.7% for various strength and pH chlorine dioxide solutions.

TABLE I

| STARTING SOLUTION | | FINAL SOLUTION | | PERCENT REMOVAL OF ClO2 |
|---|---|---|---|---|
| gpL ClO2 | pH | gpL ClO2 | pH | FROM SOLUTION |
| 7.54 | 3.07 | 1.20 | 3.39 | 84.1% |
| 8.11 | 3.40 | 2.54 | 3.40 | 69.7% |
| 4.12 | 5.80 | 0.75 | 7.10 | 81.8% |
| 6.72 | 5.55 | 1.65 | 6.91 | 75.4% |
| 5.77 | 6.82 | 1.25 | 7.84 | 78.3% |
| 5.76 | 6.95 | 1.10 | 8.15 | 80.9% |
| 10.00 | 3.30 | 0.93 | — | 90.7% |

EXAMPLE 5

The same electrochemical cell assembly as in Example 2 was operated to obtain a chlorine dioxide product solution with a lower final pH. Operating at a constant voltage of between about 2.8 to about 3.0 volts with a current varying between about 31 to about 35 amperes, the pH of the chlorine dioxide solution product solution was kept between about 3.0 to about 4.0. The product chlorine dioxide concentration was about 5.0 to about 6.5 gpL, with about 0.2 to about 2.0 gpL of unreacted sodium chlorite.

This translated into a chlorite yield conversion rate of between about 70 to about 90% and an operating current efficiency of between about 60 to about 70% in the single flow through pass operation. This cell operation with the anolyte maintained at a lower or acid pH demonstrates that less undesired by-product chlorate is generated than when the electrolytic cell is operated with an anolyte maintained at a higher pH in the alkaline range. The undesired by-product sodium chlorate concentration was between about 0.0 to about 1.0 gpL at the varying daily operating conditions. The chlorine dioxide production rate was between about 2.8 to about 3.5 pounds per day.

It appears that at more strongly alkaline conditions above a pH of about 10 in the anolyte, the product chlorine dioxide is unstable and slowly dissociates into sodium chlorite and sodium chlorate.

COMPARATIVE EXAMPLE A

An electrochemical cell was assembled with identical cell components to that of Example 1, except that an uncoated titanium metal plate was used as the anode conductor backplate or current distributor. A high surface area graphite felt anode was employed. The anodic surface area to volume ratio for the low surface area graphite felt anode was about 300 $cm^2/cm^3$. The ratio of the total surface area of the anode to the superficial surface or projected area of the membrane was about 50.0.

The chlorite feed solution flowrate to the cell was varied as well as the product solution pH during a test run which extended over a period of more than 400 hours of operation. Operating the cell at a constant voltage of about 3.45 volts, the cell current slowly decreased with time from about 29 amperes to a low of about 12.4 amperes after 400 hours of operation. The titanium metal anode backplate was apparently increasingly forming a non-conductive oxide surface with time. This demonstrates that the anode conductor backplate requires a stable conductive surface for use in this process.

COMPARATIVE EXAMPLE B

A smaller scale size electrochemical cell was assembled with identical cell components to that of Example 1, except that a low oxygen overvoltage oxide coated titanium expanded metal mesh was used as the anode conductor backplate or current distributor. The oxide coating was an iridium oxide based Englehard PMCA 1500 oxygen evolving anode coating available from Englehard Minerals and Chemicals Corp. of Edison, N.J. The internal cell dimensions were 3.0 inches (7.62 cm) by 12 inches (30.48 cm) wide by ¼ inch (0.635 cm) deep. The anodic surface area to volume ratio for the high surface area graphite felt anode was about 300 $cm^2/cm^3$. The ratio of the total surface area of the anode to the superficial surface or projected area of the membrane was about 50.0.

The cell performance was much lower in the sodium chlorite conversion yield to the chlorine dioxide product solution at similar operating voltages to those in Examples 1-4. At a constant operating voltage of about 3.6 to about 4.10 volts, the chlorite yield to chlorine dioxide was between about 13 to about 21% at an operating current between about 10 to about 15 amperes. A large quantity of oxygen gas was noted in the anolyte product solution flowstream. At lower operating voltages of about 2.8 to about 3.5 volts, the current dropped to very low levels producing a very low total quantity of chlorine dioxide product output.

This demonstrates that the anode conductor backplate requires a stable, high oxygen overvoltage conductive surface in order to produce significant quantities of chlorine dioxide.

COMPARATIVE EXAMPLE C

The same electrochemical cell as was used in Example 1, except employing about a 100 microinch gold plated titanium backplate was assembled and used as the anode without using a high surface area graphite felt anode of Example 1. About a 0.061" (0.155 cm) thick polypropylene mesh was used between the gold plated anode backplate and the Dow 985 equivalent weight cation membrane to provide adequate flow distribution in the anolyte compartment. The cathode plate position was adjusted to compensate for the residual cell gap by the addition of sufficient layers of polypropylene spacer behind the cathode in the catholyte compartment to adequately compress the membrane between the cathode and anode polypropylene mesh. The anodic surface area to volume ratio for the high surface area graphite felt anode was about 6.45 $cm^2/cm^3$ as a function of the gap or spacing between the membrane and the anode. The ratio of the total surface area of the anode to the superficial surface or projected area of the membrane was about 1.0.

Operating at a constant voltage of 3.50 volts, the cell current was limited to a maximum of 20 amperes at a high sodium chlorite feed concentration of 15.96 gpL. The product solution contained 5.26 gpL chlorine dioxide and about 7.38 gpL unreacted sodium chlorite with a solution pH of about 5.60. The sodium chlorite conversion yield was reduced to about 44% and cell chlorine dioxide production rate was lowered to 2.27 lb/day.

Operating the cell for 8 hours at a higher constant voltage of about 4.01 volts, the cell current was limited to about 18.60 amperes at a chlorite feed solution concentration of about 15.53 gpL. The product solution contained about 4.35 gpL chlorine dioxide with about 8.02 gpL unreacted sodium chlorite with a solution pH of about 3.01. The sodium chlorite conversion yield was 37.6% and chlorine dioxide production rate was further reduced to about 1.81 lb/day.

This demonstrates that a high surface area electrode structure is required to obtain a high conversion of sodium chlorite to chlorine dioxide.

COMPARATIVE EXAMPLE D

The same electrochemical cell as was used in Example 2 having a 100 microinch platinum plated titanium anode backplate was assembled. About a 0.025 inch (0.0635 cm) thick platinum clad on niobium expanded metal mesh was spot welded to the platinum plated titanium anode backplate. This combined structure was used as the anode, without any high surface area graphite cloth or other material as was used in Example 2. The expanded niobium mesh had about a 125 microinch (3.175 micron) thick platinum clad layer on both sides of the mesh and was obtained from Vincent Metals Corporation of Providence, R.I. The anodic surface area to volume ratio for this anode was about 31 $cm^2/cm^3$ and the ratio of the total surface area of the anode to the superficial surface or projected area of the membrane was about 2.0. A DuPont Nafion® 117 cation membrane was positioned against the expanded platinum clad expanded metal mesh. The cathode plate position was adjusted to compensate for the residual cell gap by the addition of sufficient layers of polypropylene spacer behind the cathode in the cathode chamber to adequately compress the membrane between the cathode and expanded platinum clad expanded metal mesh.

Operating for 8 hours at a constant voltage of about 3.33 volts, the cell current was limited to a maximum of about 20 amperes at a sodium chlorite feed concentration of about 10.72 gpL. The product solution contained about 4.52 gpL chlorine dioxide and about 3.83 gpL unreacted sodium chlorite with a solution pH of about 2.97. The sodium chlorite conversion yield was about 56.6% and the cell chlorine dioxide production rate was about 2.1 lb/day.

The cell was then disassembled and two layers of the same 0.020 inch (0.0508 cm) graphite cloth as in Example 2 was pressed between the platinum clad expanded metal mesh and the cation membrane and the cathode readjusted for the spacing. Operating the cell at a constant voltage of about 3.38 volts, the cell current increased significantly to about 31.80 amperes at a chlorite feed solution concentration of about 11.28 gpL. The product solution contained about 5.85 gpL chlorine dioxide with about 2.56 gpL unreacted sodium chlorite with a solution pH of about 5.85. The sodium chlorite conversion yield increased to about 69.5% and the chlorine dioxide production rate was increased to about 2.95 lb/day.

This example further demonstrates that the use of suitable high surface area anode structures increases the conversion of sodium chlorite to chlorine dioxide in the single pass flow through system even at slightly acidic product pH values.

While the preferred structure in which the principles of the present invention have been incorporated as shown and described above, it is to be understood that the invention is not to be limited to the particulr details thus presented, but, in fact, widely different means may be employed in the practice of the broader aspects of this invention.

For example, the cell 10 can also be arranged in a bipolar cell type arrangement using a solid plate type anode/cathode conductor or backplate. The anode/-cathode combination could be a platinum clad layer on stainless steel, titanium, or niobium which is commercially available and is prepared by heat/pressure bonding. The platinum layer would be about 125 to about 250 microinches thick to reduce cost. In this design there would be separators/spacers between the membrane and cathode side to provide a hydrogen gas release zone.

The cell 10 could be operated in a system utilizing a single pass through design or in a system utilizing an anolyte recycle loop feed type operation to achieve optimum sodium chlorite conversion to chlorine dioxide in the anode compartment. Further, the product solution from the electrolytic cell 10 can be operated to produce a high concentration chlorine dioxide solution containing up to about 14 gpL. The chlorine dioxide can then be sparged from the solution with air or nitrogen to transfer the chlorine-free chlorine dioxide in the gas phase to a process using it in, for example, municipal water treatment, gas sterilization systems, and fumigant systems. The gaseous chlorine dioxide from the solution can be easily removed down to a level of about 0.5 to about 1.0 gpL, for a removal efficiency of the chlorine dioxide from the solution on the order of about 90% or better for about 10 to about 14 gpL chlorine dioxide solutions.

Also, although the material of construction for the anolyte and catholyte compartments has been described in Example 1 as acrylic plastic, other suitable corrosion resistant materials are possible. Suitable corrosion resistant metals such as titanium, tantalum, niobium, zirconium or other valve metals, as well synthetic materials such as polyethylene, polyvinyl chloride, polyester resin or fiber reinforced resins could also be employed.

It should be understood that the catholyte could be any suitable aqueous solution, including alkali metal chlorides, and any appropriate acids such as hydrochloric sulfuric, phosphoric, nitric, acetic or others. It is also possible to operate the cell 10 and the instant process with any appropriate separator, not merely a cation exchange membrane, as long as the separator is permeable to anions and cations to obtain the required electrical conductivity therethrough. Any microporous separator is acceptable and where an aqueous acid solution is used as the catholyte, the separator can be a diaphragm of the type used in diaphragm electrolytic cells. In this case some back migration of anions from the catholyte compartment to be anolyte compartment is expected and may be permissible, depending upon the application of the final product.

Where stronger chlorine dioxide product solutions are required, it is possible to obtain the desired product by using a higher concentration alkali metal chlorite feed solution of, for example, from about 50 to about 70 gpL in conjuction with an above atmospheric pressure in the cell 10. The higher pressure, from about 1.2 to about 5 atmospheres, is necessary to prevent the potentially esxplosive chlorine dioxide at concentrations of above about 50 gpL from coming out of solution into the explosive vapor phase.

The scope of the appended claims is intended to encompass all obvious changes in the details, materials, and arrangements of parts, which will occur to one of skill in the art upon a reading of the disclosure.

Having thus described the invention, what is claimed is:

1. A continuous electrochemical process for producing chlorine dioxide solution from an aqueous alkali metal chlorite solution in an electrolytic cell having an aqueous catholyte solution and a separator between the anolyte and catholyte compartments, comprising the steps of:

(a) feeding an aqueous alkali metal chlorite solution into the anolyte compartment of the electrolytic cell to form the anolyte;

(b) feeding an aqueous solution into the catholyte compartment of the cell to form the aqueous catholyte solution;

(c) electrolyzing the anolyte by directing the anolyte in a single pass through a porous, high surface area anode having a surface area to volume ratio of at least about 50 $cm^2/cm^3$ to convert chlorite ions on the high surface area anode to produce a chlorine-free solution of chlorine dioxide in the anolyte compartment and to cause the alkali metal ions to pass through the separator into the catholyte compartment; and (d) removing the chlorine dioxide solution from the anolyte compartment.

2. The process according to claim 1 further comprising maintaining the concentration of the aqueous alkali metal chlorite solution between about 0.1 to about 30 grams per liter.

3. The process according to claim 1 further comprising maintaining the temperature of the anolyte and the catholyte during cell operation between about qb 5 degrees centigrade to about 50 degrees centigrade.

4. The process according to claim 1 further comprising operating the cell with a current density of between about 0.1 to about 10 kiloamperes per square meter.

5. The process according to claim 1 further comprising maintaining the residence time of anolyte in the cell from between about 0.1 to about 10 minutes.

6. The process according to claim 1 further comprising using a porous high surface areas anode having a void fraction of greater than about 40 percent.

7. The process according to claim 6 further comprising operating the cell with an operating voltage of between about 2.0 to about 5.0 volts.

8. The process according to claim 1 further comprising using a dilute alkali metal hydroxide solution as the aqueous catholyte solution.

9. The process according to claim 8 further comprising electrolyzing the catholyte to produce gaseous hydrogen and alkali metal hydroxide in the catholyte compartment.

10. The process according to claim 9 further comprising removing the gaseous hydrogen and alkali metal hydroxide from the catholyte compartment.

11. The process according to claim 10 further comprising using sodium or potassium as the alkali metal.

12. The process according to claim 1 further comprising operating the cell with an anolyte pH of between about 2.0 to about 10.0.

13. The process according to claim 1 further comprising operating the cell at a pressure of between about 1.2 to about 5 atmospheres.

14. The process according to claim 1 further comprising operating the cell with a cation permselective membrane as the separator.

15. The process according to claim 1 further comprising operating the cell with water as the aqueous catholyte solution.

* * * * *

UNITED STATES PATENT AND TRADEMARK OFFICE
CERTIFICATE OF CORRECTION

PATENT NO. : 5,041,196

DATED : August 20, 1991

INVENTOR(S) : Cawlfield et al.

It is certified that error appears in the above-identified patent and that said Letters Patent is hereby corrected as shown below:

In column 6 at line 11, please delete "$ClO_2$ ---> e- + $ClO_2$" and insert --$ClO_2^-$ ---> e- + $ClO_2$-- in its place.

In column 8 at line 20, please delete "consistng" and insert --consisting-- in its place and at line 27 after "deep" delete "," and insert --.-- in its place.

In column 9 at line 61, please delete "Mich.)" and insert --Michigan-- in its place.

In column 10 at line 26, please delete "gaphite" and insert --graphite-- in its place.

In column 14 at line 4, please delete "particulr" and insert --particular-- in its place, at line 45, please delete "could" and insert --can-- in its place and at line 68, please delete "esxplosive" and insert --explosive-- in its place.

UNITED STATES PATENT AND TRADEMARK OFFICE

CERTIFICATE OF CORRECTION

PATENT NO. : 5,041,196

DATED : August 20, 1991

INVENTOR(S) : Cawlfield et al

It is certified that error appears in the above-identified patent and that said Letters Patent is hereby corrected as shown below:

In column 16 at line 1, after "about" and before "5", please delete "qb", at line 10 after "surface" and before "anode", please delete "areas" and insert --area-- in its place, at line 14 after "2.0" and before "about", please delete "to" and insert --and-- in its place and at line 32 before "about", please delete "to" and insert --and-- in its place.

Signed and Sealed this

Sixth Day of July, 1993

*Attest:*

Michael K. Kirk

MICHAEL K. KIRK

*Attesting Officer*

*Acting Commissioner of Patents and Trademarks*